US005253365A

United States Patent [19]

Clevenhagen

[11] Patent Number: 5,253,365

[45] Date of Patent: Oct. 19, 1993

[54] BASEBALL OR SOFTBALL GLOVE CONSTRUCTED TO FACILITATE CLOSURE OF THE GLOVE

[75] Inventor: Robert L. Clevenhagen, Ava, Mo.

[73] Assignee: Figgie International Inc., Willoughby, Ohio

[21] Appl. No.: 886,426

[22] Filed: May 20, 1992

[51] Int. Cl.[5] ..... A41D 13/10

[52] U.S. Cl. ..... 2/19

[58] Field of Search ..... 2/16, 19, 20, 161 A, 2/159

[56] References Cited

U.S. PATENT DOCUMENTS

| | | | |
|---|---|---|---|
| 2,284,920 | 6/1942 | Nolte | 2/19 |
| 2,452,695 | 11/1943 | Sonnett et al. | 2/19 |
| 3,898,696 | 8/1975 | Campanis | 2/19 |
| 4,346,481 | 8/1982 | Latina | 2/19 |
| 4,847,915 | 7/1989 | Keene | 2/19 |
| 5,031,238 | 7/1991 | Hayes | 2/161 A |

FOREIGN PATENT DOCUMENTS

| | | | |
|---|---|---|---|
| 1128701 | 8/1982 | Canada | 2/161 A |

OTHER PUBLICATIONS

Roland N. Latina Glove Pattern; ca. 1976.

Rawlings Sporting Goods Company; 1966 Spring & Summer Catalog.

*Primary Examiner*—Clifford D. Crowder

*Assistant Examiner*—Diana L. Biefeld

*Attorney, Agent, or Firm*—Senniger, Powers, Leavitt & Roedel

[57] ABSTRACT

A baseball or softball glove constructed to facilitate closure of the glove. The glove is designed readily to flex along a flex line extending up from the heel of the glove, generally midway between the sides of the glove, and through the ball-catching pocket of the glove. The heel of the glove has little or no padding at the flex line to facilitate closing of the glove along the flex line.

7 Claims, 2 Drawing Sheets

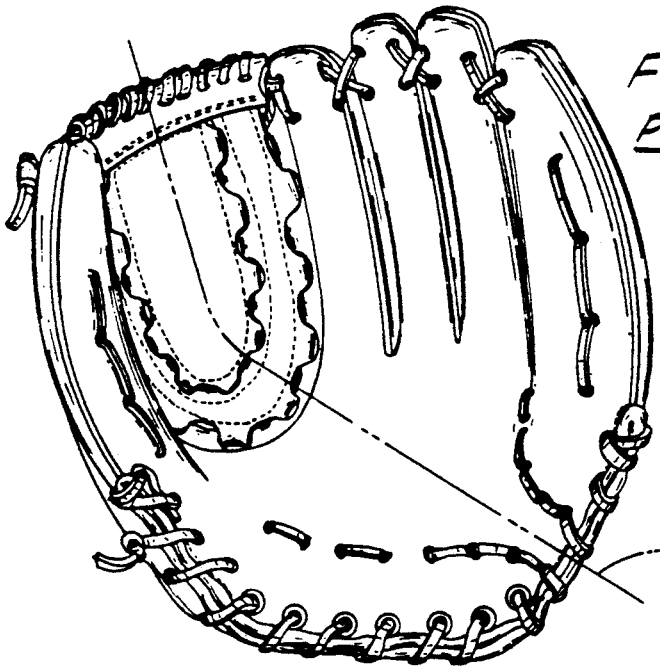
FIG. 1
PRIOR ART
FIG. 2
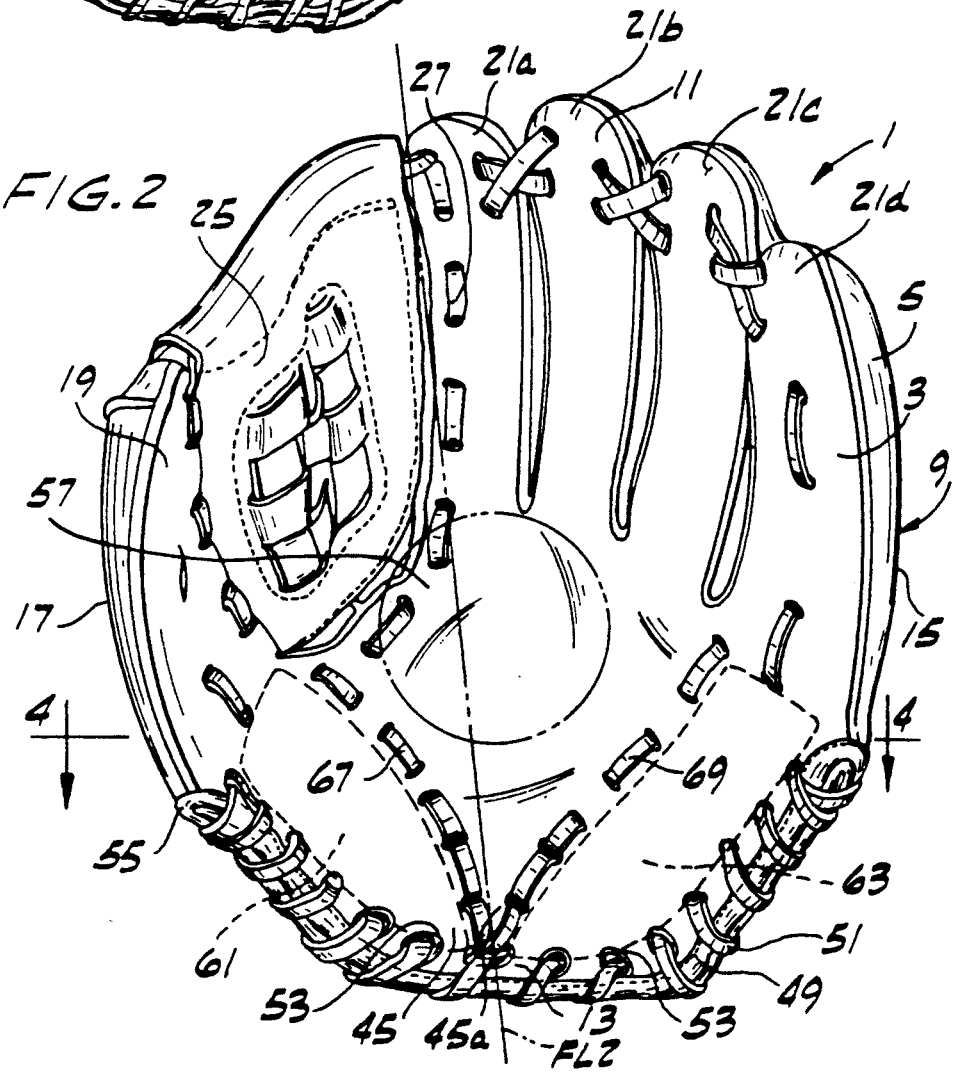

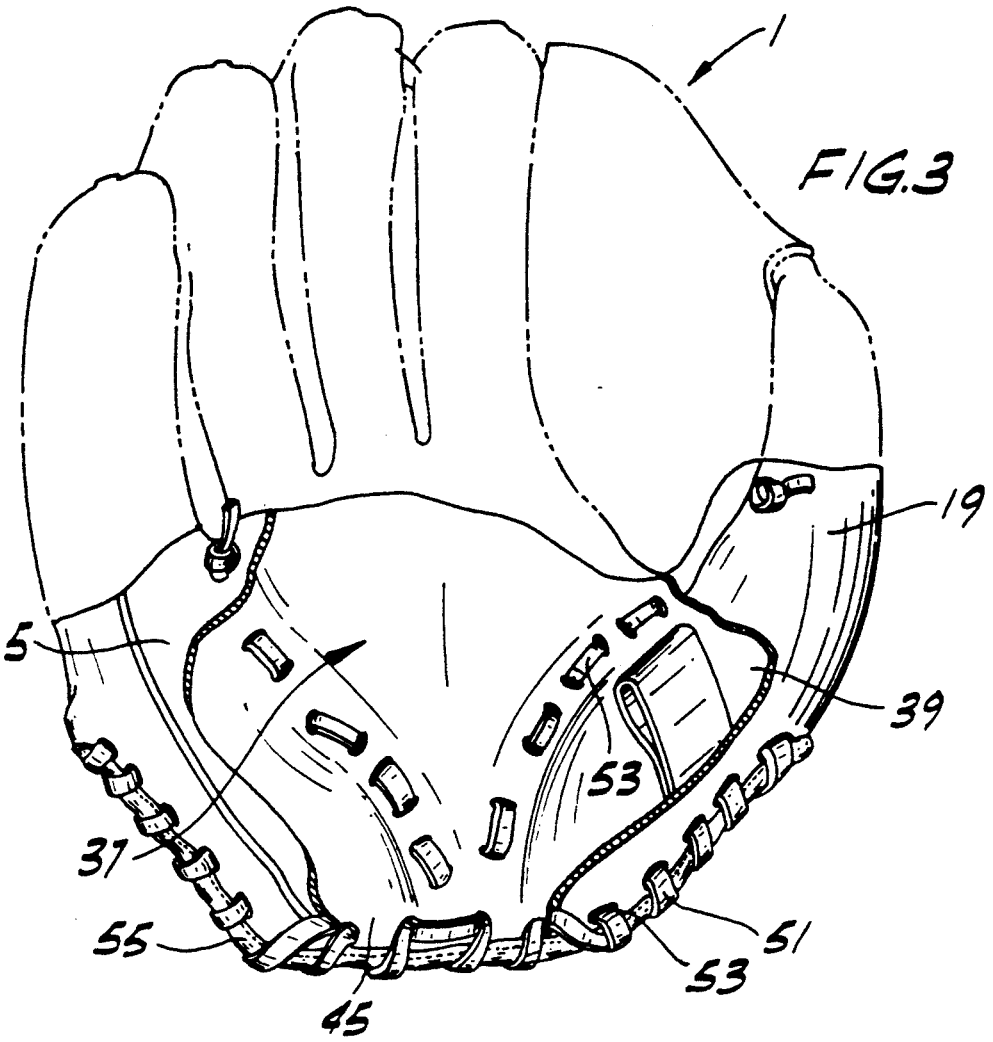
FIG. 3
FIG. 4
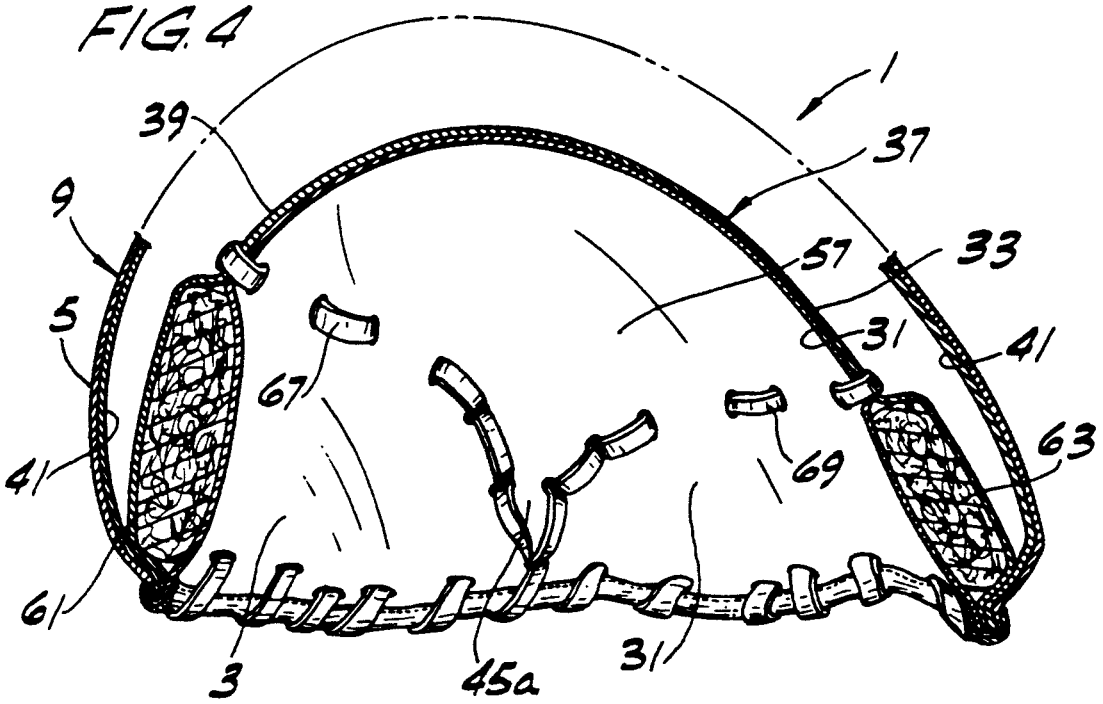

BASEBALL OR SOFTBALL GLOVE CONSTRUCTED TO FACILITATE CLOSURE OF THE GLOVE

BACKGROUND OF THE INVENTION

This invention relates generally to baseball (and softball) gloves and more particularly to such a glove which is constructed to facilitate closure of the glove.

The present invention has particular (but not exclusive) application to gloves for young people, or to others with little hand strength. Gloves constructed in conventional fashion are difficult to close, especially when new. One reason for this is that a glove of typical construction tends to close or "break" along a flex line FL 1 which, as shown in FIG. 1, starts at one side of the glove generally adjacent the bottom of the glove and extends diagonally across the ball-catching pocket of the glove toward the web of the glove. The position of this flex line requires that substantial force be applied by the fingers of the hand, and especially the little finger, to close the glove. Small children and others with little hand strength may not be able to exert the required force, thus making it very difficult to close the glove. There is a need, therefore, for a glove which is relatively easy to flex and close, even by a child.

Reference may be made to co-assigned U.S. Pat. No. 4,847,915 for a glove having a flexible heel construction generally relevant to this invention.

SUMMARY OF THE INVENTION

Among the several objects of this invention may be noted the provision of a baseball (or softball) glove which is constructed to facilitate closure of the glove; the provision of such a glove which is designed especially (albeit not exclusively) for children and others with relatively little hand strength; the provision of such a glove which requires less "break in" time; the provision of such a glove which provides for a greater effective ball catching area; the provision of such a glove which improves formation of a ball catching pocket; the provision of such a glove which is attractive in appearance and durable; and the provision of such a glove which is economical to manufacture.

In general, this invention is directed to a baseball or softball glove constructed to facilitate closure of the glove. The glove comprises a front panel forming the front wall of the glove and a back panel forming the back wall of the glove. The front and back panels are secured together at peripheral margins of the glove to form a glove shell having a top, bottom and opposite sides, a thumb stall for receiving the thumb of the hand, and finger stall means for receiving the fingers of the hand. A web is located between the thumb stall and said finger stall means. Means is provided for securing the web to the thumb stall and the finger stall means. The front panel has an outside face forming the front surface of the glove and an inside face. A liner in the shell comprises a palm liner panel on the inside face of the front panel of the glove. The front panel and the palm liner panel have lower edge margins generally in registry with one another to form a heel of the glove extending between opposite sides of the glove at the bottom of the glove. The outside face of the front panel of the glove has a central portion forming a ball-catching pocket located above the heel of the glove and below the web and said finger stall means. Flex means enables the glove readily to flex along a flex line extending up from the heel of the glove, generally midway between the sides of the glove, and through the ball-catching pocket. The heel has little or no padding at the flex line to facilitate closing of the glove along the flex line.

Other objects and features will be in part apparent and in part pointed out hereinafter.

BRIEF DESCRIPTION OF THE DRAWINGS

FIG. 1 is a front elevation of a glove of conventional construction;

FIG. 2 is a front elevation of a baseball or softball glove constructed in accordance with this invention to facilitate closure of the glove;

FIG. 3 is a bottom plan of the glove; and

FIG. 4 is a section taken on line 4—4 of FIG. 2.

Corresponding parts are designated by corresponding reference numerals throughout the several views of the drawings.

DETAILED DESCRIPTION OF THE PREFERRED EMBODIMENT

Referring now to the drawings, and particularly to FIG. 2, there is generally indicated at 1 a glove constructed in accordance with the present invention to facilitate closure of the glove and thus make it more readily usable by children and others with less hand strength than an adult. The glove comprises a front panel 3 forming the front wall of the glove and a back panel 5 forming the back wall of the glove. The front and back panels are secured (e.g., sewn) together at peripheral margins of the glove to form a glove shell generally indicated at 9 having a top 11, a bottom 13, opposite sides 15, 17, a thumb stall 19, and finger stall means comprising a plurality of finger stalls **21*a*–21*d*. It will be understood that while a fielder's glove having four finger stalls is shown in the drawings, for purposes of illustration, this invention is also applicable to gloves and mitts having one or more finger stalls. A web 25 is disposed between the thumb stall 19 and the first finger stall 21*a* and is secured in place by conventional lacing 27. The front panel 3 of the glove has an outside face 31 forming the front surface of the glove and an inside face 33 (see FIG. 4). Disposed in the shell is a liner, generally designated 37, comprising a palm liner panel 39 having an outside face for engagement by the palm of the hand when the hand is in the shell 9, and an inside face facing the inside face 33 of the front panel 3 of the glove. The liner 37 also includes a back liner panel 41** engageable with the back of the hand when the hand is in the glove, but it will be understood that this liner panel may be omitted without departing from the scope of this invention.

The front panel 3 and the palm liner panel 39 of the glove have lower edge margins generally in registry with one another to form a heel 45 of the glove extending between opposite sides 15, 17 of the glove adjacent the bottom of the glove. Stitching 49 and lacing 51 passing through eyelets 53 secure the front panel and the palm liner panel together at the bottom of the glove. This lacing 49 and stitching 51 also extend partway up the sides 15, 17 of the glove to secure the front and back glove panels 3, 5 to one another. Suitable trim 55 is provided to cover raw edges of the glove. The outside face 31 of the front panel 3 has a central portion forming a ball-catching pocket 57 located above the heel 45 of the glove generally adjacent the lower part of the web 25 and finger stalls **21*a*–21*d***.

To provide additional protection and shock absorbing capabilities, elongate thumb and finger pads designated 61 and 63, respectively, are disposed in the shell between the front panel 3 and palm liner panel 39 of the glove, the thumb and finger pads extending from generally adjacent the top 11 of the glove down to generally adjacent the bottom 13 of the glove adjacent opposite sides 15, 17 of the glove. These pads are spaced apart at the bottom of the glove to leave a relatively narrow unpadded portion 45*a* of the heel 45 therebetween generally midway between the sides of the glove. As will appear, this unpadded portion, in combination with two lines of lacing indicated at 67 and 69, enable ready flexing of the glove along a flex line FL 2 extending up from the central heel portion 45*a* of the glove, in a substantially straight line through the ball-catching pocket 57, and generally along the first finger stall 21*a* of the glove and generally parallel to and adjacent the juncture between the first finger stall and the web 25 of the glove. This flex line generally corresponds to the centerline of the glove.

The two lines of lacing 67, 69 are stitched through the front panel 3 and palm panel liner 39 of the glove and are arranged in a generally V-shaped formation, with the apex of the V disposed generally at the unpadded portion 45*a* of the heel of the glove, and with the legs of the V diverging upwardly away from the heel on opposite sides of the ball-catching pocket 57 so that the latter is disposed generally between the two legs of the V. These two lines of lacing 67, 69 also function to hold the thumb and finger pads 61, 63 in place. The two lines of lacing 67, 69 are preferably (but not necessarily) formed by a single piece of lace (e.g., leather lace), the ends of which form the upper ends of the V-shaped formation and which are knotted on the outside of the back panel 5 of the glove to secure the lace in place.

The V-formation of the lacing 67, 69, and the lack of any substantial padding at the apex of this formation, combine to form flex line FL 2 which generally corresponds to the centerline of the glove. This is advantageous for a number of reasons. First, the force required to close the glove along this "center" flex line FL2 is less than that required to close the glove along a conventional "side" flex line FL 1 shown in FIG. 1. This is because closing a glove of conventional design requires flexing or bending of the back of the glove across the back of the glove in the knuckle area, whereas the "center" break glove of this invention eliminates this flexing and thus reduces the force required to close the glove. Second, children are more readily able to close the glove because they can place their fingers on opposite sides of the "center" flex line FL2 even though their fingers are very short, whereas in a "side" break glove, their fingers may not be long enough to be placed on opposite sides of the break, thereby making it very difficult to close or "break" the glove. And third, the "center" flex line FL2 tends to direct a ball being caught toward the center of the glove (rather than toward the web of the glove as in conventional "side" break gloves), thereby maximizing the effective ball-catching area of the glove.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A baseball or softball glove constructed to facilitate closure of the glove, comprising a front panel forming the front wall of the glove and a back panel forming the back wall of the glove, said front and back panels being secured together at peripheral margins of the glove to form a glove shell having a top, bottom and opposite sides, a thumb stall for receiving the thumb of the hand, and finger stall means for receiving the fingers of the hand, a web located between the thumb stall and said finger stall means, means for securing the web to the thumb stall and said finger stall means, said front panel having an outside face forming the front surface of the glove and an inside face, a liner in the shell comprising a palm liner panel on the inside face of the front panel of the glove, said front panel and said palm liner panel having lower edge margins generally in registry with one another to form a heel of the glove extending between opposite sides of the glove at the bottom of the glove, the outside face of the front panel of the glove having a central portion forming a ball-catching pocket located above the heel of the glove and below the web and said finger stall means, and flex means enabling the glove readily to flex along a flex line extending up from the heel of the glove, generally midway between the sides of the glove, and through the ball-catching pocket, said heel having little or no padding at said flex line to facilitate closure of the glove along said flex line, wherein said flex means comprises two lines of lacing extending up from the heel of the glove, said lacing being stitched through the front panel and palm liner panel of the glove, said lines of lacing diverging as they extend upwardly from the heel of the glove in a generally V-shaped formation with the apex of the V generally at the center of the heel and the legs of the V generally on opposite sides of said ball-catching pocket.

2. A glove as set forth in claim 1 wherein said flex line extends generally parallel to and adjacent the juncture of the web and said finger stall means.

3. A glove as set forth in claim 2 wherein said flex line is a substantially straight line.

4. A baseball or softball glove constructed to facilitate closure of the glove, comprising a front panel forming the front wall of the glove and a back panel forming the back wall of the glove, said front and back panels being secured together at peripheral margins of the glove to form a glove shell having a top, bottom and opposite sides, a thumb stall for receiving the thumb of the hand, and finger stall means for receiving the fingers of the hand, a web located between the thumb stall and said finger stall means, means for securing the web to the thumb stall and said finger stall means, said front panel having an outside face forming the front surface of the glove and an inside face, a liner in the shell comprising a palm liner panel on the inside face of the front panel of the glove, said front panel and said palm liner panel having lower edge margins generally in registry with one another to form a heel of the glove extending between opposite sides of the glove at the bottom of the glove, the outside face of the front panel of the glove having a central portion forming a ball-catching pocket located above the heel of the glove and below the web and said finger stall means, and flex means enabling the glove readily to flex along a flex line extending up from the hell of the glove, generally midway between the sides of the glove, and through the ball-catching pocket, said heel having little or no padding at said flex line to facilitate closure of the glove along said flex line, the glove further comprising elongate thumb and finger pads in the shell of the glove disposed between the front panel and palm liner panel of the glove, said thumb and finger pads extending from generally adjacent the top of the glove down to generally adjacent the bottom of the glove adjacent opposite sides of the glove, said thumb and finger pads being spaced apart at the bottom of the glove to leave a relatively unpadded portion of the heel therebetween generally midway between the sides of the glove, said flex line extending up from said relatively unpadded portion of the heel, and wherein said flex means comprises two lines of lacing extending up from said relatively unpadded portion of the heel of the glove, said lacing being stitched through the front panel and palm liner panel of the glove, said lines of lacing diverging as they extend upwardly from the heel of the glove in a generally V-shaped formation with the apex of the V generally at the center of the heel and the legs of the V generally on opposite sides of said ball-catching pocket.

5. A glove as set forth in claim 4 wherein said lines of lacing function to hold said thumb and finger pads in place.

6. A glove as set forth in claim 4 wherein said flex line extends generally parallel tot he juncture of the web and said finger stall means.

7. A glove as set forth in claim 6 wherein said flex line is a substantially straight line.

* * * * *

UNITED STATES PATENT AND TRADEMARK OFFICE

CERTIFICATE OF CORRECTION

PATENT NO. : 5,253,365

DATED : October 19, 1993

INVENTOR(S) : Robert L. Clevenhagen

It is certified that error appears in the above-identified patent and that said Letters Patent is hereby corrected as shown below:

Column 4, claim 4, line 67, "the hell of the glove" should read ---the heel of the glove---.

Column 6, claim 6. line 12, "tot he juncture" should read ---to the juncture---.

Signed and Sealed this

Thirty-first Day of May, 1994

Bruce Lehman

*Attest:*

BRUCE LEHMAN

*Attesting Officer*

*Commissioner of Patents and Trademarks*